US007951315B2

(12) United States Patent
Sakurai et al.

(10) Patent No.: US 7,951,315 B2
(45) Date of Patent: May 31, 2011

(54) POLYVINYL CHLORIDE FIBER FOR ARTIFICIAL HAIR, MANUFACTURING AND APPARATUS OF THE SAME

(75) Inventors: Akira Sakurai, Kanagawa (JP); Akira Moroi, Kanagawa (JP)

(73) Assignee: Denki Kagaku Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/344,811

(22) Filed: Dec. 29, 2008

(65) Prior Publication Data

US 2009/0115093 A1 May 7, 2009

Related U.S. Application Data

(62) Division of application No. 10/574,412, filed as application No. PCT/JP2004/014258 on Sep. 29, 2004, now abandoned.

(30) Foreign Application Priority Data

Oct. 3, 2003 (JP) ..... 2003-345334

(51) Int. Cl.
*B29C 47/12* (2006.01)

(52) U.S. Cl. ..... 264/177.13; 425/378.2; 425/382.2; 425/131.5; 425/464; 425/83.1

(58) Field of Classification Search ..... 425/131.5, 425/464, 83.1, 378.2, 382.2; 264/177.13
See application file for complete search history.

(56) References Cited

U.S. PATENT DOCUMENTS 3,152,362 A * 10/1964 Carter ..... 425/464
3,521,324 A * 7/1970 Hartmann ..... 425/66
4,013,816 A * 3/1977 Sabee et al. ..... 442/401
5,512,114 A * 4/1996 Short et al. ..... 148/565
5,731,010 A * 3/1998 Kikutani et al. ..... 425/131.5
5,869,107 A * 2/1999 Shimizu et al. ..... 425/131.5
6,140,442 A * 10/2000 Knight et al. ..... 526/348.1
6,156,842 A * 12/2000 Hoenig et al. ..... 525/171
6,234,778 B1 * 5/2001 Belch et al. ..... 425/69
6,312,804 B1 * 11/2001 Yamane et al. ..... 428/364
6,465,099 B1 * 10/2002 Yamane et al. ..... 428/401
2006/0172097 A1 * 8/2006 Morikoshi et al. ..... 428/35.7
2007/0077424 A1 * 4/2007 Sakurai et al. ..... 428/375
2008/0139705 A1 * 6/2008 Adachi ..... 524/80

FOREIGN PATENT DOCUMENTS

| | | |
|---|---|---|
| JP | 5576102 | 6/1980 |
| JP | 62156308 | 7/1987 |
| JP | 3175222 | 4/1993 |
| JP | 6346309 | 12/1994 |
| JP | 10168647 | 6/1998 |
| JP | 11061555 | 3/1999 |
| JP | 20011319823 | 5/2001 |
| JP | 2002266160 | 9/2002 |
| WO | WO9840545 A1 | 9/1998 |

* cited by examiner

*Primary Examiner* — Joseph S Del Sole
*Assistant Examiner* — David N Brown, II
(74) *Attorney, Agent, or Firm* — Reising Ethington P.C.

(57) ABSTRACT

The present invention is to provide a polyvinyl chloride (PVC) fiber for artificial hair. The PVC fiber is manufactured by melt spinning a PVC resin composition with a nozzle, wherein the nozzle has a nozzle hole having a diameter D and a land length L, and a nozzle leading portion having a cone angle, and wherein a ratio of L/D is 1-3, a height of the nozzle leading portion is at least 4 mm, and the cone angle is 20°-90°. The resulting PVC fiber has an arithmetic mean roughness of 0.18-0.38 μm and a maximum height of 0.5-3.5 μm along a longitudinal direction, specified by JIS B 0601.

7 Claims, 2 Drawing Sheets

POLYVINYL CHLORIDE FIBER FOR ARTIFICIAL HAIR, MANUFACTURING AND APPARATUS OF THE SAME

REFERENCE TO RELATED APPLICATIONS

The present application is a Divisional Application of U.S. patent application Ser. No. 10/574,412, filed on Mar. 31, 2006 now abandoned which claims the benefit of Japanese Patent Application No. 2003-345334 filed on Oct. 3, 2003, and to Japanese PCT Application No. PCT/JP2004/014258 filed on Sep. 29, 2004, the disclosures of which are hereby incorporated by reference as though set forth fully herein.

TECHNICAL FIELD

The present invention relates to a polyvinyl chloride (PVC) fiber for artificial hair having a natural gloss, hue and appearance and utilized for hair ornament products, such as wigs, hairpieces, braids, and extension hairs, and relates to a manufacturing and apparatus of the same.

RELATED ART

Synthetic resins, such as polyester fiber, acrylics fiber, and polyvinyl chloride (PVC) fiber, have been utilized for artificial hair. The PVC fiber especially has strength, elongation percentage, transparency and stable curling so that it is utilized for artificial hair fiber for head hair. However, the synthetic resins formed by melt spinning have a flat surface, a strong gloss and tactile impression of plastic so that the synthetic resins have appearances far from the natural hair.

In order to solve the problem, JP-3,175,222,B discloses that inorganic particles such as silicon oxide and organic particles such as cross-linked polystyrene are added to the polyester fiber to form a specified protrusion on a surface thereof. The polyester fiber disclosed reduces the gloss and slipping but does not reach to the natural hair with respect to the gloss, tactile impression and appearance. The art disclosed in JP-3,175,222,B is adapted to a manufacturing of the polyvinyl chloride (PVC) fiber. However, since the PVC resin has a high melting viscosity, the PVC resin composition added with the inorganic particles such as silicon oxide and the organic particles such as cross-linked polystyrene causes a thread breakage during melt spinning and lowers the productivity.

JP,S62-156308,A discloses that a melt spun polyamide fiber is cool treated to provide an irregular surface thereon. The polyamide fiber disclosed in JP,S62-156308,A reduces the gloss and slipping but does not reach to the natural hair with respect to the gloss, tactile impression and appearance. The art disclosed in JP,S62-156308,A is adapted to the manufacturing of the PVC fiber. However, the resultant fiber has a small irregular surface so that the fiber does not reach to the natural hair with respect to the gloss, tactile impression and appearance.

JP,S55-76102,A discloses a filament A, which has an even number of protrusions radially on an outer surface thereof, a filament B, which has an odd number of protrusions radially on an outer surface thereof, and a filament C, which is assembled with two or three circular filaments juxtaposed to each other and has the same contact length as the radius of each filament, and that these filaments are mixed together to form a wig filament. The wig filament does not reach to the natural hair with respect to the gloss, tactile impression and appearance depending on the sectional shape of the filament and the mixing ratio.

DISCLOSURE OF THE INVENTION

The present invention is to provide a polyvinyl chloride (PVC) fiber for artificial hair having a natural gloss, tactile impression and appearance with strength and formability, and a method for manufacturing the same and an apparatus thereof.

According to a first aspect of the present invention, a polyvinyl chloride (PVC) fiber for artificial hair has an arithmetic mean roughness Ra of 0.18-0.38 μm and a maximum height Ry of 0.5-3.5 μm along a longitudinal direction, specified by JIS B 0601, and the PVC fiber is manufactured by melt spinning a PVC resin composition with a nozzle. The nozzle has a nozzle hole having a diameter D and a land length L, and a nozzle leading portion having a cone angle. A ratio of L/D is 1-3, a height of the nozzle leading portion is at least 4 mm, and the cone angle is 20°-90°.

Preferably, the PVC fiber has a section specified by $(L*M_{max})/S$ of 4.2-7.0, wherein $M_{max}$(mm) is the maximum line segment, S(mm$^2$) is a sectional area, and L(mm) is a length of an outer circumference.

Preferably, the PVC resin composition contains 100 parts by mass of a PVC resin, (a) 0.3-3.0 parts by mass of a higher fatty acid ester lubricant, (b) 0.3-1.5 parts by mass of a polyethylene lubricant, with a mixing ratio (a)/(b) of 0.5-4.

Preferably, the PVC resin composition contains 0.2-5.0 parts by mass of an inorganic thermal stabilizer selected from a hydrotalcite or zeolite.

According to a second aspect of the present invention, a method of manufacturing a polyvinyl chloride (PVC) fiber for artificial hair, includes the steps of: melt spinning a PVC resin composition with a nozzle having a nozzle hole having a diameter D and a land length L and a nozzle leading portion having a cone angle, wherein a ratio of L/D is 1-3, a height of the nozzle leading portion is at least 4 mm, and the cone angle is 20°-90°; and discharging the PVC resin composition with an amount of 65-165 g/h per nozzle.

Preferably, the PVC resin composition contains 100 parts by mass of a PVC resin, (a) 0.3-3.0 parts by mass of a higher fatty acid ester lubricant, and (b) 0.3-1.5 parts by mass of a polyethylene lubricant, with a mixing ratio (a)/(b) of 0.5-4.

Preferably, the PVC resin composition contains 0.2-5.0 parts by mass of an inorganic thermal stabilizer selected from a hydrotalcite or zeolite.

Preferably, the method further includes the step of discharging the PVC resin composition with an amount of 80-150 g/h.

According to a third aspect of the present invention, a melt spinning apparatus for manufacturing a polyvinyl chloride fiber for artificial hair, has a nozzle and the nozzle includes: a nozzle hole having a diameter D and a land length L; and a nozzle leading portion having a cone angle, wherein a ratio of L/D is 1-3, a height of the nozzle leading portion is at least 4 mm, and the cone angle is 20°-90°.

BEST MODE FOR CARRYING OUT THE INVENTION

Figure 1:
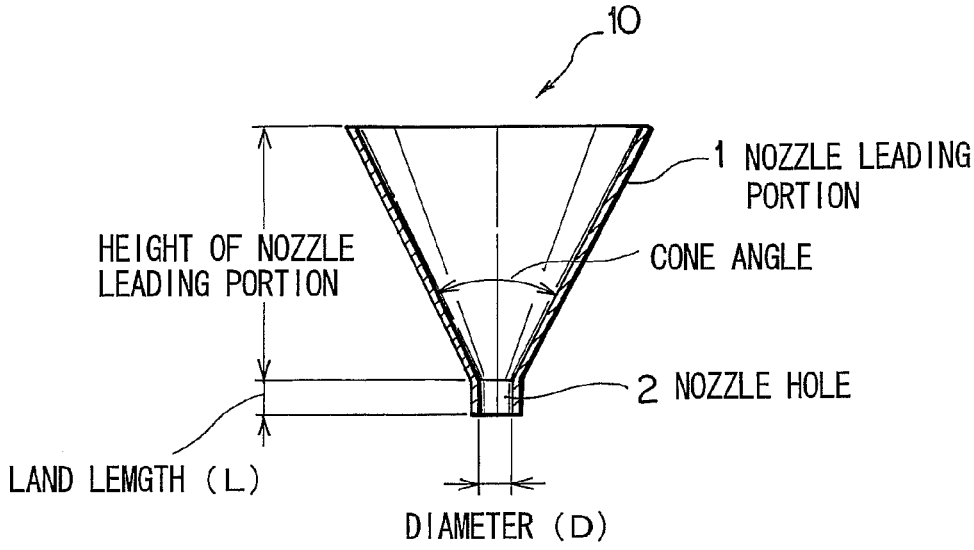
FIG. 1 is a schematic sectional view of a nozzle for manufacturing a polyvinyl chloride (PVC) fiber for artificial hair of an embodiment of the present invention by melt spinning a PVC resin composition.
Figure 2:
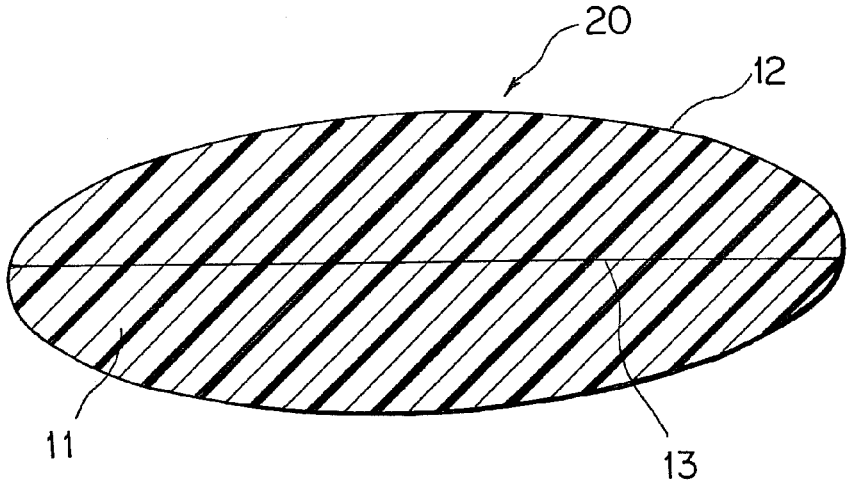
FIG. 2 is a schematic sectional view of the PVC fiber for artificial hair of another embodiment of the present invention.
Figure 3:
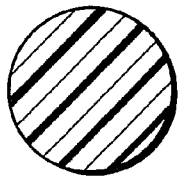
FIG. 3 is a schematic sectional view of a PVC fiber having a circular section.
Figure 4:
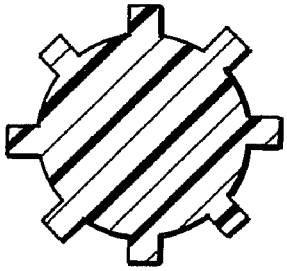
FIG. 4 is a schematic sectional view of a PVC fiber having a gear-shaped section.
Figure 5:
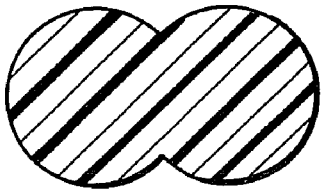
FIG. 5 is a schematic sectional view of a PVC fiber having glasses-shaped section.
Figure 6:
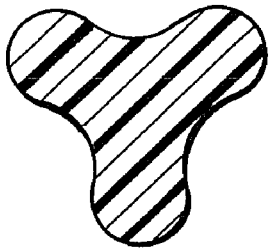
FIG. 6 is a schematic sectional view of a PVC fiber having a Y-shaped section.
Figure 7:
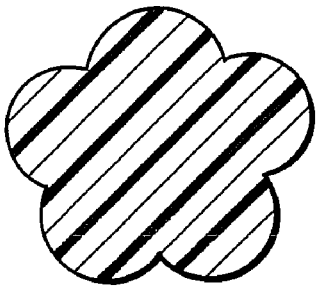
FIG. 7 is a schematic sectional view of a PVC fiber having a five-leaf shaped section.

FIG. 1 is a schematic sectional view of an embodiment of a nozzle of the present invention for manufacturing a polyvinyl chloride (PVC) fiber for artificial hair by melt spinning a PVC resin composition;

FIG. 2 is a schematic sectional view of an embodiment of the PVC fiber for artificial hair of the present invention;

FIG. 3 is a schematic sectional view of other embodiment of the PVC fiber for artificial hair of the present invention having a circular section;

FIG. 4 is a schematic sectional view of other embodiment of the PVC fiber for artificial hair of the present invention having a gear-shaped section;

FIG. 5 is a schematic sectional view of other embodiment of the PVC fiber for artificial hair of the present invention having a glasses-shaped section;

FIG. 6 is a schematic sectional view of other embodiment of the PVC fiber for artificial hair of the present invention having a Y-shaped section; and FIG. 7 is a schematic sectional view of other embodiment of the PVC fiber for artificial hair of the present invention having a five-leaf shaped section.

The PVC fiber for artificial hair is manufactured with a nozzle 10 depicted in FIG. 1. The nozzle 10 has a nozzle hole 2 with a diameter of D and a land length L. A ratio of L/D is 1-3 and a height of a nozzle leading portion 1 is at least 4 mm. The nozzle leading portion 1 has a cone angle of 20°-90° at the nozzle hole 2. A unit nozzle discharges 65-165 g/h. The resulting PVC fiber for artificial hair has an arithmetic mean roughness Ra of 0.18-0.38 μm and the maximum height Ry of 0.5-3.5 μm along a longitudinal direction specified in JIS B 0601.

The arithmetic mean roughness Ra and maximum height Ry are determined with a noncontact laser microscope, for example, laser microscope VK-8500 of KEYENCE.

The arithmetic mean roughness Ra and maximum height Ry are calculated with a calculating formula specified in JIS B 0601. The arithmetic mean roughness is given by an Equation 1, $$Ra = \frac{1}{300}\int_0^{300} |f(x)|\,dx \qquad \text{Equation 1}$$

wherein x-axis extends longitudinally to the PVC fiber and is a mean value of the roughness of the length 300 μm and y-axis intersects to x-axis and a roughness curve is defined by y=f(x) in unit of μm.

The maximum height Ry is defined by a difference between a peak and a valley of the roughness curve extending 300 μm.

A structure of a tip of the nozzle affects the state of mixing of the PVC resin. When the nozzle has the tip of L/D less than 1, the PVC resin is extruded in a turbulent manner so that Ra and Ry become larger than 0.38 and 3.5, respectively resulting to the frequent thread breakage. When the nozzle has the tip of L/D greater than 3, the PVC resin becomes a laminar flow, Ra and Ry become smaller than 0.18 and 0.5, respectively so that the gloss is intensified and the tactile impression becomes worse. The tip of L/D less than 1 or greater than 3 is common to the spinning of polyethylene terephthalate (PET) and polypropylene (PP). However, since the PVC resin has a high melting viscosity and is subjected to a high pressure at the nozzle, the PVC fiber is affected by the tip structure specified by L/D. In the present invention, L/D is set to 1-3. For manufacturing the conventional PVC fiber with the PVC resin, L/D is usually 4-10.

The PVC resin generally has a high resin pressure so that the nozzle having small L/D can not maintain the strength thereof. Accordingly, it is necessary to specify the cone angle at the nozzle hole and the height of the nozzle leading portion. When the cone angle is smaller than 20°, the melting resin is extruded in the laminar manner and Ra becomes less than 0.18 and Ry becomes less than 0.5 so that the gloss is intensified and the tactile impression becomes worse. When the cone angle becomes larger than 90°, the resin pressure to the nozzle becomes higher and tends to damage the nozzle. The resulting values of Ra and Ry become high. In order to keep the strength of the nozzle, the height of the nozzle leading portion is kept at least 4 mm with the cone angle of 20°-90°.

When the discharge of a unit nozzle is less than 65 g/h, the mixing of the PVC resin is assisted so that Ra becomes less than 0.18 and Ry becomes less than 0.5. The resulting fiber has a strong gloss and a poor tactile impression. When the discharge of each nozzle is more than 165 g/h, the mixing of the PVC resin is not enough so that Ra becomes more than 0.38 and Ry becomes more than 3.5. The resulting fiber has a poor melt spinning, poor tactile impression and lower strength. In the present invention, the discharge of the unit nozzle is 65-165 g/h, preferably 80-150 g/h. As a result, the mixing state of the PVC resin can be controlled so as to form an irregular surface thereon to control the gloss and tactile impression.

The PVC fiber for artificial hair is manufactured by melt spinning the PVC resin composition with a condition of L/D being 1-3, where D is the diameter of the nozzle hole 2 and L is the land length of the nozzle 2, the height of the nozzle leading portion being at least 4 mm, the cone angle of the nozzle hole 2 at the nozzle leading portion 1 being 20°-90°, and the discharge of the unit nozzle being 65-165 g/h. The PVC fiber manufactured has the arithmetic mean roughness Ra of 0.18-0.38 μm and the maximum height Ry of 0.5-3.5 μm along the longitudinal direction specified in JIS B 0601. The resulting PVC fiber has strength and formability and is utilized for artificial hair having a natural gloss, tactile impression and appearance.

The PVC fiber 20 for artificial hair of the present invention has $(L*M_{max})/S$ of 4.2-7.0, wherein L(mm) is a length of an outer circumference 12, $M_{max}$(mm) is the maximum line segment 13 intersecting the gravity center, S($mm^2$) is a sectional area 11 of the fiber. These values are determined with the noncontact laser optical microscopy.

When the $(L*M_{max})/S$ is 4.2-7.0, the PVC fiber has a suppressed gloss without losing the strength thereof and the endurance of the nozzle. When the $(L*M_{max})/S$ is less than 4.2, a diffuse reflection of light is not enough so that the gloss can not be suppressed enough. When the $(L*M_{max})/S$ is more than 7.0, the endurance of the nozzle and the strength of the fiber is reduced and the productivity of the melt spinning decreases.

As the length of the outer circumference 12 and the maximum line segment 13 are large, the sectional area 11 is small, and the $(L*M_{max})/S$ is large, the irregularity of the section of the fiber increases so that the gloss is suppressed.

Preferably, the PVC resin composition of the present invention contains 100 parts by mass of the PVC resin, (a) 0.3-3.0 parts by mass of a higher fatty acid ester lubricant and (b) 0.3-1.5 parts by mass of a polyethylene lubricant with a mixing ratio (a)/(b) of 0.5-4. The resulting PVC fiber provides a natural gloss, tactile impression and appearance while keeping strength and formability.

An individual use of the higher fatty acid ester lubricant and the polyethylene lubricant decreases greatly a friction between the resin and the molding apparatus so that an agglomeration of grains is formed on the surface of the fiber and degrades the tactile impression. With the combination of the higher fatty acid ester lubricant and the polyethylene lubricant, although the reason not known, the higher fatty acid lubricant decreases the friction among the grains of the resin and provides the fiber surface having the natural gloss, tactile impression and appearance.

Preferably, the higher fatty acid ester lubricant (a) of the present invention is a fatty acid ester of alcohol or multiple alcohol. Other known lubricants can be utilized within the scope of the present invention. For example, they are hardened oil, butyl stearate, monoglycerides stearate, pentaerythritol tetrastearate, stearyl stearate or a mixture thereof.

The arithmetic mean roughness Ra and the maximum height Ry decrease as the amount of the higher fatty acid ester lubricant (a) increases. Preferably, the amount of the higher fatty acid ester lubricant (a) is 0.3-3 parts by mass with respect to 100 parts by mass of the PVC resin. When the amount thereof is less than 0.3 parts by mass, the friction among the grains of the PVC resin does not decrease so that the PVC resin is not sufficiently mixed and the agglomeration of the grains is formed on the surface of the fiber and degrades the tactile impression. When the amount thereof is more than 3 parts by mass, the higher fatty acid ester lubricant reduces too much the friction between the PVC resin and the molding apparatus so that the PVC resin is not mixed enough and decreases the spinnability.

Preferably, the polyethylene lubricant (b) has an average molecular weight of 2000-6000 and a density of 0.95-0.98. Other known lubricants can be utilized within the scope of the present invention.

The arithmetic mean roughness Ra and the maximum height Ry increase as the amount of the polyethylene lubricant (b) increases. Preferably, the amount thereof (b) is 0.3-1.5 parts by mass with respect to 100 parts by mass of the PVC resin. When the amount of the polyethylene lubricant (b) is less than 0.3 parts by mass, the PVC resin is mixed excessively so that the gloss can not be suppressed and the tactile impression becomes more slippery. When the amount of the polyethylene lubricant (b) is more than 1.5 parts by mass, the PVC resin is not mixed sufficiently so that the agglomeration of the grains is formed on the surface of the fiber and degrades the tactile impression.

The mixing ratio (a)/(b) of the higher fatty acid ester lubricant (a) and the polyethylene (b) is preferably 0.5-4. When the mixing ratio (a)/(b) is less than 0.5, the friction in the spinning apparatus decreases much more and the PVC resin is not mixed sufficiently so that the agglomeration of the grains is formed on the surface of the fiber and degrades the tactile impression. When the mixing ratio (a)/(b) is more than 4, the higher fatty acid ester lubricant reduces too much the friction between the PVC resin and the surface of the spinning apparatus, and the PVC resin is not mixed enough so that the spinnability is reduced.

The surface roughness of the PVC fiber of the present invention can be adjusted with an additive, a control of molding and a post treatment besides the lubricants.

Preferably, the PVC resin composition contains 0.2-5.0 parts by mass of an inorganic thermal stabilizer selected from hydrotalcite or zeolite. The addition of the inorganic thermal stabilizer to the PVC resin composition forms the irregularity on the surface of the fiber and provides an artificial hair with the gloss being suppressed.

The surface roughness of the PVC fiber of the present invention can be adjusted with a combination of the known method, such as the additive, the control of molding and the post treatment, besides the lubricants.

The control of the surface roughness with the additive is achieved by controlling the amount of the thermal stabilizer or modifying resin, or by changing the shape, for example fine powder, of the additive. For example, a cross-linking polymethyl methacrylate keeps the shape after the melt spinning so that the arithmetic mean roughness Ra and maximum height Ry can be adjusted with the control of the mean diameter and amount of the additive. The addition of the cross-linking polymethyl methacrylate having a mean diameter of 3 μm changes Ry little and increases Ra. The addition thereof with a mean diameter of 8 μm increases Ry without changing Ra.

The control to adjust the molding condition is to change (1) temperature of a cylinder of an extruding apparatus or die at the melt spinning, (2) a number of rotation of a screw, (3) temperature at a stretching process and a stretching length, (4) temperature and length for thermal relaxing the stretched fiber. For example, when the temperature of the cylinder is lowered, the mixing of the PVC resin becomes worse so that the arithmetic mean roughness Ra and the maximum height Ry become large. When the PVC fiber is heat treated at a higher temperature, the surface shape thereof is relaxed so that the arithmetic mean roughness Ra and the maximum height Ry become small.

A vibration of an order of micrometer is applied, directly or indirectly through air or coolant, to a nozzle or the fiber injected from the nozzle at the melt spinning so as to form the irregularity of the natural hair to the fiber.

The surface of the fiber can be controlled with a post treatment such as a chemical treatment with a chemical agent, or a physical treatment with a plasma discharge or gear forming to control the arithmetic mean roughness Ra.

The PVC resin of the present invention includes (1) resins formulated from bulk, solution, suspension and emulsion polymerization of a vinyl chloride, but not limited to the steps, such as polyvinyl chloride, chlorinated polyvinyl chloride, polyvinylidene chloride, chlorinated polyethylene, vinyl chloride-acetic acid vinyl copolymer, vinyl chloride-ethylene copolymer, vinyl chloride-propylene copolymer, vinyl chloride-styrene copolymer, vinyl chloride-isobutylene copolymer, vinyl chloride-vinylidene chloride copolymer, vinyl chloride-styrene-maleic anhydride terpolymer, vinyl chloride-styrene-acrylonitrile terpolymer, vinyl chloride-butadiene copolymer, vinyl chloride-isoprene copolymer, vinyl chloride-chlorinated propylene copolymer, vinyl chloride-vinylidene chloride-acetic acid vinyl terpolymer, vinyl chloride-maleic acid ester copolymer, vinyl chloride-methacrylic acid ester copolymer, vinyl chloride-acrylonitrile copolymer, vinyl chloride-several vinyl ether copolymers, (2) a blend among the resins of (1), (3) a synthetic resin not containing the above and chlorine, such as acrylonitrile-styrene copolymer, acrylonitrile-styrene-butadiene terpolymer, ethylene-acetic acid vinyl copolymer, ethylene-ethyl (meta) acrylate copolymer, blends with polyester, and (4) vinyl chloride-polymerized containing block copolymer and graft copolymer.

A mean degree of polymerization of the PVC resin is preferably 600-1600. The mean degree of polymerization of less than 600 lowers a melting viscosity and produces the fiber having a high thermal contraction. The mean degree of polymerization of more than 1600 increases the melting viscosity and increases the molding temperature resulting to a color change to the fiber.

The PVC resin composition for manufacturing the fiber may contain known additives utilized for the PVC composition, such as plasticizer, lubricant, compatible agent, processing assist, strengthening agent, ultraviolet absorption agent, oxidization prevention agent, anti-electric agent, filler, flame retardant, pigment, initial coloring improvement agent, conductive grant agent, finishing agent, optical stabilizer, and spice.

The PVC fiber for artificial hair of the present invention has a diameter of 20-100 denier, or preferably 50-80 denier. The fiber with the diameter of 20-100 denier appears like natural human hair and the fiber of 50-80 denier has an improved tactile impression and appearance.

The PVC fiber for artificial hair of the present invention may have any sectional shapes shown in FIGS. 3-7.

The PVC fiber is melt spun with the nozzle 10, as shown in FIG. 1, of the ratio L/D of 1-3 for the nozzle hole diameter D and land length L, having the height of the nozzle leading portion of at least 4 mm and the cone angle of 20-90° at the nozzle leading portion 1, with the discharge amount of 65-165 g/h. The resulting PVC fiber provides the artificial hair having the natural gloss, tactile impression and appearance while maintaining strength and formability.

The PVC resin composition preferably contains 100 parts by mass of the PVC resin, (a) 0.3-3.0 parts by mass of the higher fatty acid ester lubricant and (b) 0.3-1.5 parts by mass of the polyethylene lubricant with the ratio (a)/(b) of 0.5-4. The resulting PVC fiber provides the artificial hair having the natural gloss, tactile impression and appearance while maintaining strength and formability.

The PVC resin composition preferably contains 0.2-5.0 parts by mass of the inorganic thermal stabilizer selected from the hydrotalcite or zeolite. The resulting PVC fiber provides the artificial hair having the suppressed gloss with ease of formation of the irregularity on the surface thereof.

In the present invention, the amount of the discharge is selected to 80-150 g/h to achieve the PVC fiber having the natural gloss, tactile impression and appearance while maintaining strength and formability.

The PVC resin composition is in the form of the powder compound prepared by Henschel mixer or ribbon blender, or a pellet compound melt together. A single extruder, twin extruder or conical twin extruder is utilized for manufacturing the PVC fiber at a temperature of 170-190° C. Finally, the PVC fiber is processed through the stretching process and thermal relaxing process.

The shape of the section of the PVC fiber, related to $(L*M_{max})/S$, is adjusted by changing the nozzle shape at the melt spinning. In the present invention, the shape of the section of the PVC fiber is not specifically limited and may have the sections shown in FIGS. 3-7. The value of $(L*M_{max})/S$ is 4.0 for the circular shape and becomes larger as the shape becomes complicated.

Known resins or additives can be added to the PVC resin composition as far as the arithmetic mean roughness Ra and maximum height Ry are maintained within a tolerance. The resin is such as chlorinated polyethylene resin, chlorinated PVC resin, polymethylmethacrylate resin, polyurethane resin, ethylene acetic acid vinyl resin, ethylene acetic acid vinyl/vinyl chloride resin, and polyvinyl alcohol resin. The known additives utilized for the PVC resin composition are strengthening agent, ultraviolet absorption agent, oxidization prevention agent, anti-electric agent, filler, flame retardant, pigment, initial coloring improvement agent, conductive grant agent, finishing agent, optical stabilizer, and spice.

The PVC fiber of the present invention has the diameter of 20-100 denier, or preferably 50-80 denier. The fiber with the diameter of 20-100 denier appears like natural human hair and the fiber of 50-80 denier has the improved tactile impression and appearance.

The PVC fiber is melt spun with the nozzle 10, as shown in FIG. 1, of the ratio L/D of 1-3 for the nozzle hole diameter D and land length L, having the height of the nozzle leading portion of at least 4 mm and the cone angle of 20°-90° at the nozzle leading portion 1. The resulting PVC fiber provides artificial hair having the natural gloss, tactile impression and appearance while maintaining strength and formability.

EXAMPLE

Example 1

A PVC resin composition contains 100 parts by mass of a PVC resin (TAIYO-ENBI, TH-1000), 3 parts by mass of a hydrotalcite (KYOWA-KAGAKU, ALCAMIZER-1), 0.6 parts by mass of a 12 zinc hydroxystearate (NISSAN-KAGAKU, NF-12Zn), 0.4 parts by mass of a 12 calcium hydroxystearate (NISSAN-KAGAKU, NF-12Ca), and a lubricant including 4.0 parts by mass of a higher fatty acid ester lubricant (RIKEN-BITAMIN, EW-100) and 0.2 parts by mass of a polyethylene wax (MITUI-SEKIYU-KAGAKU, Hiwax400P) with a mixing ratio of 20. A nozzle for melt spinning has a section area of 0.06 $mm^2$, L/D of 3, where D is the diameter of the nozzle hole and L is the land length, the height of nozzle leading portion of 5 mm, and the cone angle of 50°. The PVC resin composition is melt spun with 120 nozzles, each having a circular section, at a temperature of 175° C. with a discharge amount of 125 g/h. The melt spun PVC fiber has the circular section shown in FIG. 3 and a mean fineness of 180 denier. The PVC fiber is stretched to 300% at a temperature of 105° C. in air. The PVC fiber is then heat treated at a temperature of 110° C. in air until the length thereof contracts to 75% of the length prior to the heat treatment to achieve the PVC fiber of the mean fineness of 60 denier.

Example 2

Comparing to Example 1, a mixing ratio of the lubricant is changed to 1.7 and the lubricant contains 1.0 parts by mass of the fatty ester lubricant (RIKEN-BITAMIN, EW-100) and 0.6 parts by mass of the polyethylene wax (MITUI-SEKIYU-KAGAKU, Hiwax 400P).

Example 3

Comparing to Example 1, the mixing ratio of the lubricant and the shape of the nozzle hole are changed. The mixing ratio is 0.1 and the lubricant contains 0.2 parts by mass of the higher fatty acid ester lubricant (RIKEN-BITAMIN, EW-100) and 1.6 parts by mass of the polyethylene wax (MITSUI-SEKIYU-KAGAKU, Hiwax 400P). The gear-shaped die of the nozzle hole, as shown in FIG. 4, having the $(L*M_{max})/S=7.4$ is utilized for producing the PVC fiber having a mean fineness of 180 denier.

Example 4

Comparing to Example 1, the mixing ratio of the lubricant and the shape of the nozzle hole are changed. The mixing ratio is 1.7 and the lubricant contains 1.0 part by mass of the higher fatty acid ester lubricant (RIKEN-BITAMIN, EW-100) and 0.6 parts by mass of the polyethylene wax (MITUI-SEKIYU-KAGAKU, Hiwax 400P). The gear shaped die of the nozzle hole, as shown in FIG. 4, having the $(L*M_{max})/S=7.4$ is utilized for producing the PVC fiber having a mean fineness of 180 denier.

Example 5

Comparing to Example 1, the mixing ratio of the lubricant and the shape of the nozzle hole are changed. The mixing ratio is 0.3 and the lubricant contains 0.4 parts by mass of the higher fatty acid ester lubricant (RIKEN-BITAMIN, EW-100) and 1.2 parts by mass of the polyethylene wax (MITUI-SEKIYU-KAGAKU, Hiwax 400P). The glasses shaped die of the nozzle hole, as shown in FIG. 5, having the $(L*M_{max})/S=5.6$ is utilized for producing the PVC fiber having a mean fineness of 180 denier.

Example 6

Comparing to Example 1, the mixing ratio of the lubricant and the shape of the nozzle hole are changed. The mixing ratio is 1.7 and the lubricant contains 1.0 part by mass of the higher fatty acid ester lubricant (RIKEN-BITAMIN, EW-100) and 0.6 parts by mass of the polyethylene wax (MITUI-SEKIYU-KAGAKU, Hiwax 400P). The glasses shaped die of the nozzle hole, as shown in FIG. 5, having the $(L*M_{max})/S=5.6$ is utilized for producing the PVC fiber having a mean fineness of 180 denier.

Example 7

Comparing to Example 1, the mixing ratio of the lubricant and the shape of the nozzle hole are changed. The mixing ratio is 0.5 and the lubricant contains 0.2 parts by mass of the higher fatty acid ester lubricant (RIKEN-BITAMIN, EW-100) and 0.4 parts by mass of the polyethylene wax (MITUI-SEKIYU-KAGAKU, Hiwax 400P). The Y-shaped type die of the nozzle hole, as shown in FIG. 6, having the $(L*M_{max})/S=5.6$ is utilized for producing the PVC fiber having a mean fineness of 180 denier.

Example 8

Comparing to Example 1, the mixing ratio of the lubricant and the shape of the nozzle hole are changed. The mixing ratio is 3.5 and the lubricant contains 0.7 parts by mass of the higher fatty acid ester lubricant (RIKEN-BITAMIN, EW-100) and 0.2 parts by mass of the polyethylene wax (MITUI-SEKIYU-KAGAKU, Hiwax 400P). The five-leaf shaped die of the nozzle hole, as shown in FIG. 7, having the $(L*M_{max})/S=5.6$ is utilized for producing the PVC fiber having a mean fineness of 180 denier.

Comparative Example 1

Comparing to Example 1, the mixing ratio of the lubricant and the shape of the nozzle hole are changed. The mixing ratio is 1.7 and the lubricant contains 1.7 parts by mass of the higher fatty acid ester lubricant (RIKEN-BITAMIN, EW-100) and 1.4 parts by mass of the polyethylene wax (MITUI-SEKIYU-KAGAKU, Hiwax 400P). The glasses-shaped die of the nozzle hole, as shown in FIG. 5, having the $(L*M_{max})/S=5.6$ is utilized for producing the PVC fiber having a mean fineness of 180 denier.

Comparative Example 2

Comparing to Example 1, the mixing ratio of the lubricant and the shape of the nozzle hole are changed. The mixing ratio is 0.5 and the lubricant contains 0.6 parts by mass of the higher fatty acid ester lubricant (RIKEN-BITAMIN, EW-100) and 1.2 parts by mass of the polyethylene wax (MITUI-SEKIYU-KAGAKU, Hiwax 400P). The Y-shaped type die of the nozzle hole, as shown in FIG. 6, having the $(L*M_{max})/S=5.6$ is utilized for producing the PVC fiber having a mean fineness of 180 denier.

Comparative Example 3

Comparing to Example 1, the mixing ratio of the lubricant and the shape of the nozzle hole are changed. The mixing ratio is 1.0 and the lubricant contains 0.4 parts by mass of the higher fatty acid ester lubricant (RIKEN-BITAMIN, EW-100) and 0.4 parts by mass of the polyethylene wax (MITUI-SEKIYU-KAGAKU, Hiwax 400P). The Y-shaped type die of the nozzle hole, as shown in FIG. 6, having the $(L*M_{max})/S=5.6$ is utilized for producing the PVC fiber having a mean fineness of 180 denier.

Comparative Example 4

Comparing to Example 1, the mixing ratio of the lubricant and the shape of the nozzle hole are changed. The mixing ratio is 0.6 and the lubricant contains 0.8 parts by mass of the higher fatty acid ester lubricant (RIKEN-BITAMIN, EW-100) and 1.4 parts by mass of the polyethylene wax (MITUI-SEKIYU-KAGAKU, Hiwax 400P). The glasses-shaped die of the nozzle hole, as shown in FIG. 5, having the $(L*M_{max})/S=5.6$ is utilized for producing the PVC fiber having a mean fineness of 180 denier.

The PVC fibers of Examples 1-8 and Comparative Examples 1-4 are evaluated for (1) surface roughness, (2) section of the fiber, (3) gloss, (4) tactile impression, (5) strength and (6) spinnability. Each evaluation is as follows.

(1) Surface Roughness

The noncontact laser microscope (VK-8500 by KEYENCE KABUSHIKI KAISHA) is utilized with an objective 50 times and a measuring distance of 0.02 μm. The measurements are made on 10 points on each of three samples with the distance of 300 μm along the longitudinal direction so as to measure the arithmetic mean roughness Ra and the maximum height Ry specified in JIS B 0601.

(2) Section of Fiber

The noncontact laser microscope (VK-8500 by KEYENCE KABUSHIKI KAISHA) is utilized with the objective 50 times and the measuring distance of 0.1 μm. The maximum line segment $M_{max}$(μm) passing through the gravity center and the length of the outer circumference L(μm) and the sectional area(μm2) are measured to evaluate $(L*M_{max})/S$.

(3) Gloss

The gloss is evaluated by a visual examination to a bundle of 24,000 fibers under sunlight and fluorescent light. The symbols ○, Δ, X each represent that the surface of the fiber is flat and has a little gloss, that the surface of the fiber has a large irregularity and a little gloss, or the surface is flat and has a little gloss, and that the surface thereof has a large irregularity and no gloss, or the surface thereof is flat and has a strong gloss, respectively.

(4) Tactile Impression

The tactile impression is obtained from a feeling of a touch when the fibers bundled with 24,000 fibers are rubbed with hand. The symbols ○, Δ, X each represent that the tactile impression is a smooth touch, a rasping or a little slippery touch, and the rasping or a strong slippery, respectively.

(5) Strength

The strength of the fiber is measured with a Autograph AGS-5D of SHIMAZU-SEISAKUSHO. The symbols ○, Δ and X each represent that the fiber strength is at least 1.4 g/denier, 1.2-1.4 g/denier and less than 1.2 g/denier, respectively.

(6) Spinnability

The spinnability is determined from a number of thread breakage during melt spinning the PVC resin composition with 120 dies for a period of 30 min with 3 repetitions. The symbols ○, Δ and X each represent that the thread breakage is zero, once, and twice or more, respectively.

The result of the evaluation is given in TABLE 1.

| | | Example | | | | | | | | Comparative Example | | | |
|---|---|---|---|---|---|---|---|---|---|---|---|---|---|
| | | 1 | 2 | 3 | 4 | 5 | 6 | 7 | 8 | 1 | 2 | 3 | 4 |
| surface | Ra (μm) | 0.19 | 0.22 | 0.36 | 0.24 | 0.24 | 0.24 | 0.33 | 0.22 | 0.13 | 0.42 | 0.19 | 0.36 |
| morphology | Ry (μm) | 1.0 | 1.4 | 3.0 | 1.4 | 2.2 | 1.7 | 2.6 | 1.2 | 0.9 | 2.5 | 0.4 | 4.1 |
| section | $(L * M_{max})/S$ | 4.0 | 4.0 | 7.4 | 7.4 | 5.6 | 5.6 | 5.1 | 4.5 | 5.6 | 5.1 | 5.1 | 5.6 |
| of fiber | section | C | C | GE | GE | GL | GL | Y | FL | GL | Y | Y | GL |
| lubricant | M.R. | 20 | 1.7 | 0.1 | 1.7 | 0.3 | 1.7 | 0.5 | 3.5 | 1.2 | 0.5 | 1.0 | 0.6 |
| | HFE-L | 4.0 | 1.0 | 0.2 | 1.0 | 0.4 | 1.0 | 0.2 | 0.7 | 1.7 | 0.6 | 0.4 | 0.8 |
| | PE-L | 0.2 | 0.6 | 1.6 | 0.6 | 1.2 | 0.6 | 0.4 | 0.2 | 1.4 | 1.2 | 0.4 | 1.4 |
| gloss | | Δ | Δ | Δ | Δ | ○ | ○ | ○ | Δ | X | X | X | ○ |
| tactile impression | | Δ | Δ | Δ | ○ | Δ | ○ | Δ | ○ | Δ | X | Δ | X |
| strength | | ○ | ○ | Δ | ○ | ○ | ○ | ○ | ○ | ○ | X | ○ | Δ |
| spinnability | | ○ | ○ | Δ | Δ | ○ | ○ | ○ | ○ | ○ | ○ | ○ | X |

surface morphology: Ra arithmetic mean roughness, Ry maximum height
section of fiber: C circular, GE gear-shape, GL glasses, Y Y-shape, FL five-leaf
lubricant: M.R. mixing ratio, HFE higher fatty acid ester lubricant (in parts by mass), PE polyethylene lubricant (in parts by mass)

As clearly seen from TABLE 1, Examples 1-7 show that the PVC fibers have the gloss, tactile impression, strength and spinnability of at least Δ and are adapted for the product. The PVC fibers of Examples 5-8 have a level of ○ for many evaluation items. Contrary to this, Comparative Examples 1-3 show that the gloss of the fiber surface is not suppressed enough. Comparative Example 4 shows a poor spinnability and tactile impression.

INDUSTRIAL APPLICABILITY

A PVC fiber for artificial hair of the present invention has a natural gloss, tactile impression and appearance while maintaining strength and formability so that the PVC fiber is adapted for manufacturing of hair ornament products, such as wigs, hair pieces, braids, and extensions.

We claim:

1. A method of manufacturing a polyvinyl chloride (PVC) fiber for artificial hair, comprising the steps of:

melt spinning a PVC resin composition with a nozzle having a nozzle hole of a diameter D and a land length L, and a nozzle leading portion having a cone angle, wherein a ratio of L/D is 1-3, a height of the nozzle leading portion is at least 4 mm, and the cone angle is 20°-90°; and discharging the PVC resin composition with an amount of 65-165 g/h per nozzle, wherein the discharged PVC resin composition produces the PVC fiber for artificial hair, and the nozzle is designed to discharge the PVC fiber having a section specified by (L*Mmax)/S of 4.2-7.0, where Mmax(mm) is the maximum line segment, S($mm^2$) is a sectional area, and L(mm) is a length of an outer circumference of the PVC fiber.

2. The method as claimed in claim 1, wherein said PVC resin composition contains 100 parts by mass of a PVC resin, (a) 0.3-3.0 parts by mass of a higher fatty acid ester lubricant, and (b) 0.3-1.5 parts by mass of a polyethylene lubricant, with a mixing ratio (a)/(b) of 0.5-4.

3. The method as claimed in claim 1, wherein said PVC resin composition contains 0.2-5.0 parts by mass of an inorganic thermal stabilizer selected from a hydrotalcite or zeolite.

4. The method as claimed in claim 2, wherein said PVC resin composition contains 0.2-5.0 parts by mass of an inorganic thermal stabilizer selected from a hydrotalcite or zeolite.

5. The method as claimed in claim 1, further comprising the step of discharging the PVC resin composition with an amount of 80-150 g/h.

6. The method as claimed in claim 2, further comprising the step of discharging the PVC resin composition with an amount of 80-150 g/h.

7. The method as claimed in claim 3, further comprising the step of discharging the PVC resin composition with an amount of 80-150 g/h.

* * * * *